US005517762A

United States Patent [19]

Kuribayashi

[11] Patent Number: 5,517,762

[45] Date of Patent: May 21, 1996

[54] SCISSORS

[76] Inventor: Takayoshi Kuribayashi, 5-9-14 Seijo, Setagaya-ku, Tokyo, Japan

[21] Appl. No.: 410,072

[22] Filed: Mar. 24, 1995

Related U.S. Application Data

[62] Division of Ser. No. 333,609, Nov. 2, 1994.

[51] Int. Cl.[6] ..... B26B 13/04

[52] U.S. Cl. ..... 30/260; 30/254

[58] Field of Search ..... 30/131, 260, 232, 30/254, 255, 256, 257, 258, 259, 261, 262, 356

[56] References Cited

U.S. PATENT DOCUMENTS

| | | | |
|---|---|---|---|
| 639,874 | 12/1899 | Thuillier | 30/254 |
| 753,919 | 3/1904 | Rowe | 30/256 |
| 3,906,630 | 9/1975 | Megna | 30/260 |
| 5,086,563 | 2/1992 | Sakuma et al. | 30/260 |
| 5,108,343 | 4/1992 | Gilliam | 30/254 |

*Primary Examiner*—Hwei-Siu Payer
*Attorney, Agent, or Firm*—McGlew and Tuttle

[57] ABSTRACT

A pair of blade replacement type scissors in which a shaft portion of a blade portion is engaged with a groove formed in a shaft portion of a grip so that the respective shaft portions can be bolted together and in which said grip can be separated to two parts or coupled by inserting one part into the other part and fixed with a stopper screw so that the blade portion can be replaced and the length of the grip can be adjusted, and a pair of scissors in which the blade lines of said moving blade and said stationary blade are warped in the shape of arc in the same direction in order to facilitate the cutting of hair.

5 Claims, 3 Drawing Sheets

SCISSORS

This is a divisional application of application Ser. No. 08/333,609 filed Nov. 2, 1994.

BACKGROUND OF THE INVENTION

1. Field of the Invention

The present invention relates to blade replacement type scissors in which the blades thereof can be replaced, and to blade replacement type scissors in which the length of the grip can be adjusted, and to the shape of the blade thereof.

2. Description of the Related Art

Conventionally, most scissors comprise a moving blade and a stationary blade which are rotatably coupled through a shaft, the moving and stationary blades each being composed of a grip portion and a blade portion. Recently, some kinds of scissors employ ceramic for their blade portions. However, ceramic cannot be jointed with a grip made of metal or plastic by welding or bonding. Thus, in such scissors, the blade portion and the grip are jointed by bonding and further fixing with screws. Because once the blade portion and the grip are jointed by the aforementioned method, they cannot be separated.

The quality of the blades of scissors decreases with repeated use, so it is necessary to sharpen the scissors. However, sharpening requires skill and is a hard work. If the user asks a specialist to sharpen scissors' blades, it requires high cost and it takes time. Particularly, beauty experts feel a delicate difference in the shape of the grip shaft of scissors, degree of the warp of the blade, size of the handle hole, shape of the handle hole or the like. If they are unable to use their favorite scissors because they are being sharpened, there occurs a big difference in their work efficiency and performance.

The blade line of conventional scissors is a straight line type in which the moving blade and stationary blade are straight, or a round or curved type in which the center portions of the moving blade and stationary blade are expanded.

Therefore, although conventional scissors are capable of easily cutting fixed materials, thin materials such as paper or the like easily, the shapes of the blade line of the conventional scissors are inappropriate for materials which are likely to move away from the blades when being cut, such as hair. Even if the user succeeds in cutting hair using such scissors, the hair is not cut in a desired straight line because the hair is cut while moving away from the blade. Thus, this fact is a marked disadvantage for the cutting of hair by beauty experts.

SUMMARY OF THE INVENTION

Accordingly, an object of the present invention is to provide a pair of scissors in which the blades can be replaced when the quality of the blades deteriorate and in which the length of the grip thereof can he adjusted in order to meet demands of beauty experts who require delicate differences in use.

According to the present invention, it is possible to cut such things as hair which are likely to move away from the blade when both blades mesh with each other by gripping the hair with the warped blades of the scissors, which are provided by warping the blade lines of both the moving blade and the stationary blade in the form of a curve in the same direction, Consequently, it is possible to cut hair in a desired straight line.

DESCRIPTION OF THE PREFERRED EMBODIMENTS

Figure 1:
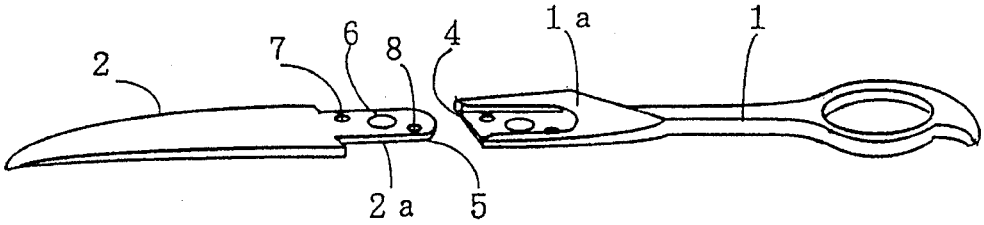
FIG. 1 is a view showing a blade and a grip separately.

An engaging groove is provided at the end on the blade side of each grip and an insertion portion is formed on the end on the grip side of each blade. The cross section of the engaging groove of the grip portion is protrusion-shaped and the inside of the engaging groove is exposed through the surface thereof. It is permissible to provide a hole in which the inside of the hole is not exposed through the external surface thereof. The cross section of the insertion portion of the blade portion is also protrusion-shaped corresponding to the aforementioned engaging groove. The insertion portions have a shaft hole on each other for rotatably mounting the blade portions, the shaft holes being provided in the center with respect to the direction for insertion. Bolt through holes for fastening the blade portion to the grip portion are provided in the front and rear of the shaft hole. The blade portion is engaged with the grip portion by means of the engaging groove and further, the blade portion is fixed to the grip portion by means of bolts located in the front and rear of the shaft mounting portion. As described above, it is possible to fasten the blade portion to the grip portion firmly using the bolt and remove them by removing the bolt. Further, according to the present invention, the arm(rod) of the grip is coupled with the handle hole portion by inserting the handle hole portion into the shaft portion in order to adjust the length of the grip.

According to the construction described above, when the quality of the blade had deteriorated or when the user wants to replace the blade with a combing-out blade, the grip portion can be separated from the blade portion easily by removing the bolt. Thus, it is not necessary to sharpen the blades and it is possible to always use favorite grips. Because the blade portions are fastened to the grip portion by tightening the bolts located in the front and the rear of the shaft in a line which joints the moving blade and the stationary blade rotatably, and the blade portions are fastened through the engaging groove having a protrusion shaped cross section, the blade portions can be fixed stably. Further, because the length of the grip portion can be adjusted by loosening the stopper screw, it is not necessary to make a special order for favorite scissors, thereby saving cost.

When an object is cut by the blades, it is desirable that the blades contact the object while the blades are being retracted. Thus, it is desirable that the moving blade is formed in the shape of arc. On the other hand, the receiving stationary blade is desired to be formed in the shape of an arc warped inward in order to prevent an object, such as hair which are likely to escape, from escaping.

As for the blade line in which the moving blade meshes with the stationary blade, one blade portion is expanded in the shape of an arc with respect to the other blade portion, or the blade portion has a straight blade line while the other blade portion is formed in the shape of arc warping inward.

As a result of experiments, it has been testified that the radius of the arc of the blade line is desired to be 35.8 mm when the length of the arc (length of the blade) is 50 mm, in order to cut hair straight without hair escaping.

According to the configuration of the blade line, hair can be cut in the form of a desired cutting line and the quality of the blade is improved. Because the blades of the construction described above enable hair to be cut much more easily than in the prior one, and hair can be cut smoothly without applying great pressure, hair cutting work is facilitated.

EXAMPLE 1

An embodiment of the present invention is described with reference to the accompanying drawing.

In scissors, one blade body, the moving blade or the stationary blade, is formed of a grip 1 and a blade portion 2. The two blade bodies are mounted on each other rotatably through a shaft in the center of the respective blade bodies (shaft mounting portion 3) so as to form a pair of scissors.

Figure 2:
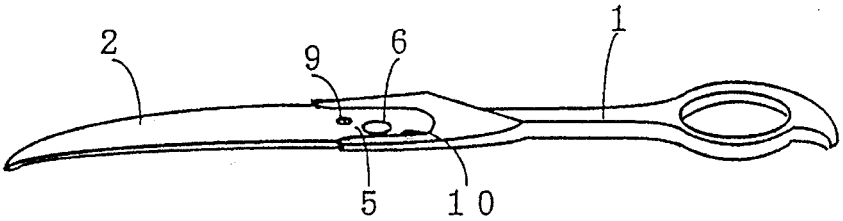
FIG. 2 is a view showing the state in which the blade is coupled with the grip.
Figure 3:
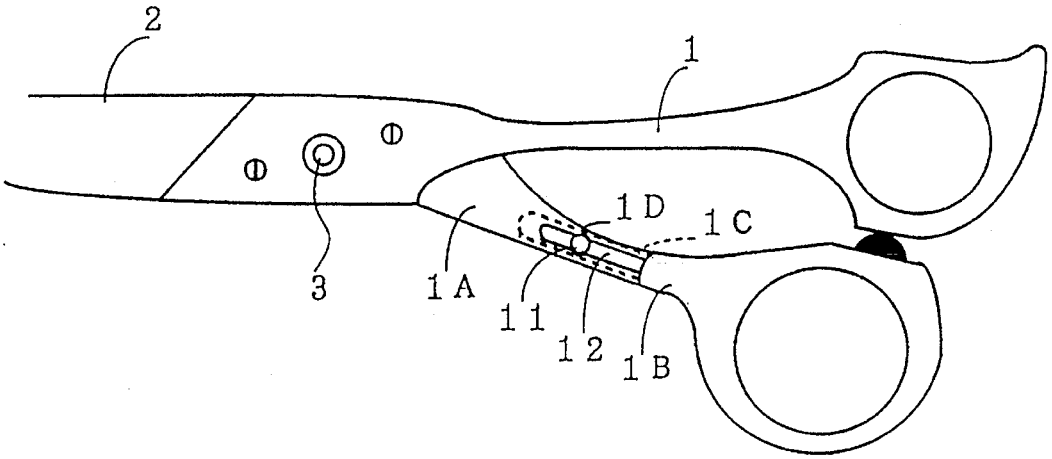
FIG. 3 is a view showing the adjustment construction of the grip.

The grip 1 and the blade portion can be separated from each other. An engaging groove 4 in which the cross section is protrusion shaped, and in which the bottom thereof is wider than the top portion in which the inside of the groove is exposed, is formed in the shaft portion la so that the engaging groove is placed in the direction from the blade portion 2. The shaft portion **2*a* on the end of the blade portion facing the grip portion has an insertion portion 5 which corresponds to the aforementioned engaging groove 4 of the grip and in which the cross section thereof is protrusion shaped. The insertion portion 5 has bolt holes 7, 8 which are formed in the front and rear of the shaft hole 6, for mounting a shaft so that the insertion holes are arranged in the direction of the grip portion from the blade portion 2. The insertion portion 5 of the blade portion is inserted into the engaging groove 4 of the grip 1 so that the blade portion is engaged with the grip portion as shown in FIG. 2. After this, the tap bolts 9, 10 are inserted through the bolt holes 6, 8 provided on the insertion portion 5 of the blade portion and the insertion portion 5 is fastened to the engaging groove 4 in order to joint the blade portion 2 with the grip 1, thereby forming the moving blade and the stationary blade. The moving blade and the stationary blade are mounted on each other and a shaft bolt is inserted through the shaft bolt hole 6 so that they are mounted rotatably through the shaft. When the blade portion 2** is replaced, the shaft bolt or other bolt is removed and the blades are replaced with new blades or combing-out blades.

As regards the adjustment of the grip, the shaft portion thereof 1A and the handle hole portion thereof 1B are separate and they are engaged with each other by inserting the handle hole portion into the shaft portion. Namely, the arm end 1C of the handle hole portion 1B has a smaller diameter than the arm end 1D on the handle hole side of the shaft portion and the arm end 1D is formed in the shape of a pipe. If possible, both the arm ends 1C and 1D are shaped in square pipe to prevent them from being rotated relative to each other. A groove 12 of the shaft portion in which a stopper screw 11 provided on the arm end 1C of the handle hole portion 1B is provided by cutting an elongated hole in the arm end 1D of the shaft portion 1A and the handle hole portion 1B is fixed to the shaft portion 1A by tightening the stopper screw 11. The length of the handle hole portion from the shaft portion can be adjusted by sliding the arm end 1C of the handle hole portion 1B with respect to the arm end 1D of the shaft portion 1A.

EXAMPLE 2

Figure 4:
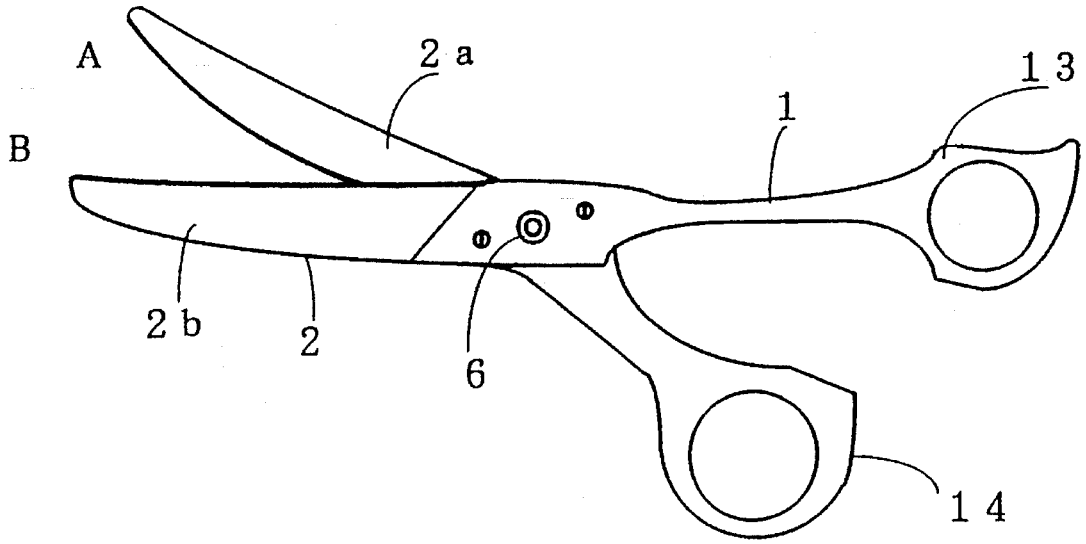
FIG. 4 is a blade replacement type scissors.

In the pair of scissors shown in FIG. 4, the moving blade **2*a* and the stationary blade 2*b* are mounted on each other through a shaft (shaft mounting portion 6). A thumb insertion hole portion 14 is provided on an end opposite to the moving blade 2*a* and a thirdfinger insertion hole portion 13 is provided on and end opposite to the blade portion B of the stationary blade 2*b***.

The blade line A of the blade portion of the moving blade **2*a* is formed in the shape of arc expanding from the end to the shaft mounting portion 6. The blade line of the blade portion of the stationary blade 2*b* is formed in the shape of arc curved inward from the end to the shaft mounting portion 6**.

Figure 5:
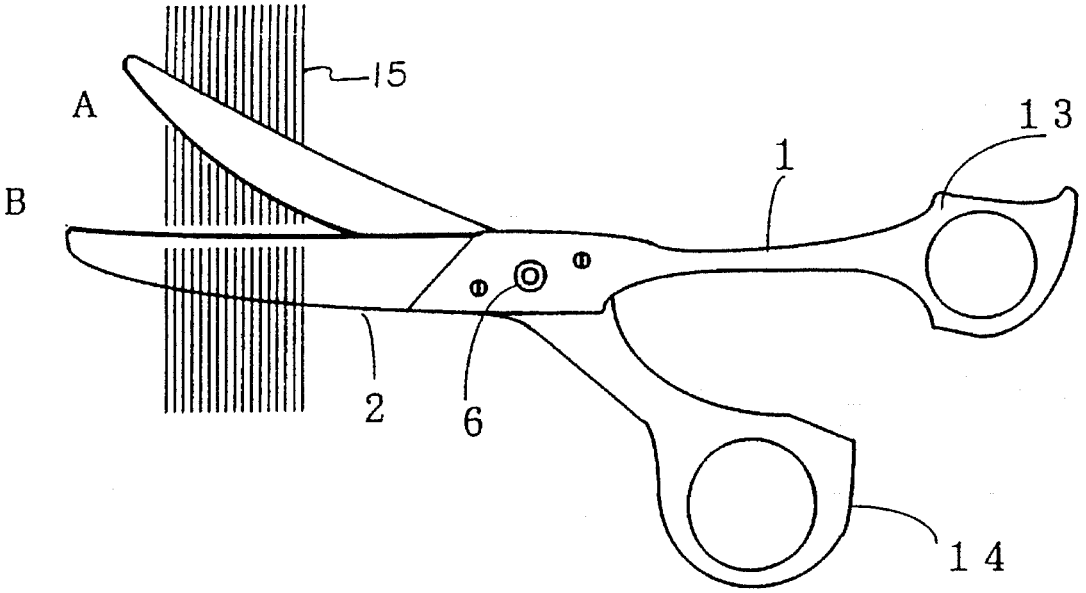
FIG. 5 is a view showing the state in which hair is cut using scissors having the shape of the present invention.
Figure 6:
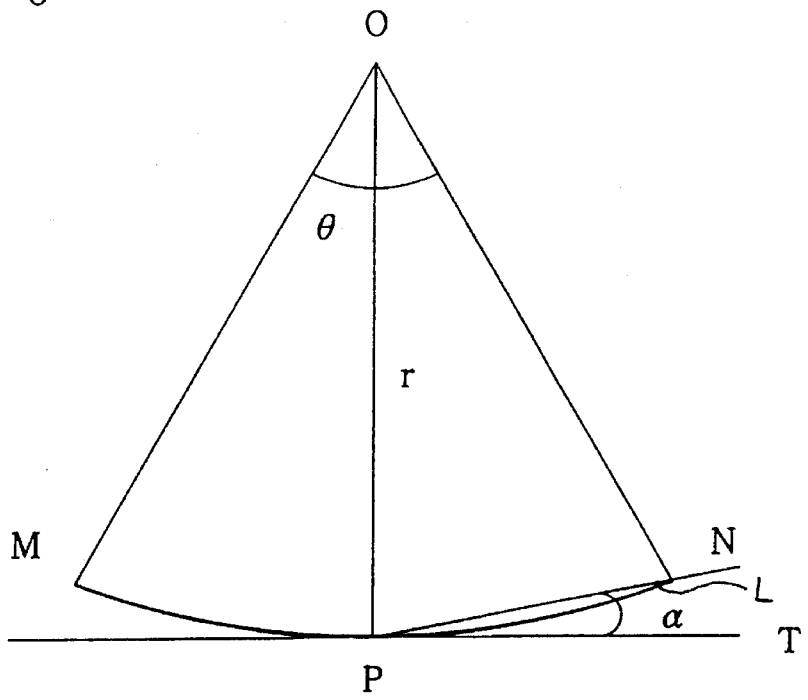
FIG. 6 is a view showing the curve line of the blade.
Figure 7:
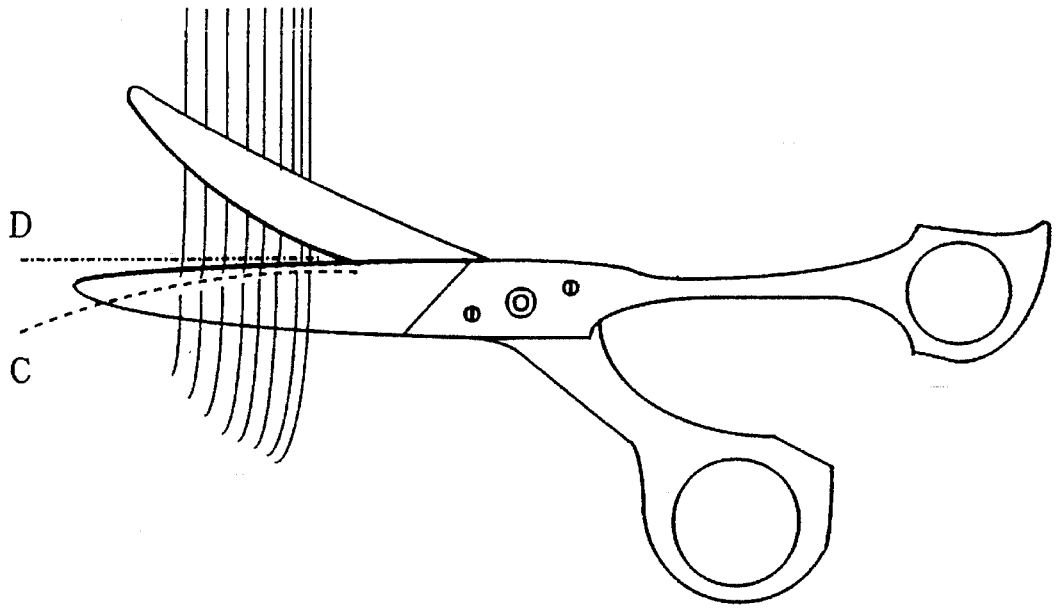
FIG. 7 (PRIOR ART)
FIG. 7 is a view showing the state in which hair is cut using conventional scissors.

When hair 15 is cut by the blade of the present invention, the hair 15 does not escape between the blades of the moving blade and the stationary blade, so that even if the scissors are not slid in the direction of the end of the blade portion, the hair is cut. Thus, according to the present invention, it is possible to cut hair along a desired cutting line (FIG. 5)

As a result of experiments, it has been made evident that as for the degree of the blade line, the angle $\alpha$ formed by the tangent line T in contact with the center point P of the arc L and both ends M, N is desired to be less than 20 when the length of the blade line is 50 mm and that the center angle $\theta$ is needed to be less than 80 in order to obtain a desired cutting line without making hair escape when being cut, When the length of the arc is 50 mm, the radius of a circle containing this arc is about 35.8 mm according to the relation of circular method.

$$L=\gamma\cdot\frac{\theta}{180}\cdot\pi$$

Therefore, an arc of a circle having a longer radius than the value obtained from the expression is desired.

On the other hand, a conventional bamboo-leaf shaped blade type scissors in which the blades of the moving blade and the stationary blade are expanded, or a conventional straight type scissors in which the blades of the moving blade and the stationary blade are straight, cuts in the cutting line C shown by an oblique dashed line which is different from the ideal cutting line D. Thus, conventionally, beauty experts must try to cut hair inversely obliquely by estimating this oblique cutting, thereby requiring great skill.

What is claimed is:

1. A pair of blade replacement type scissors, comprising:

a first scissor part and a second scissor part, each scissor part having a grip portion connected to a blade portion, said blade portion of at least one of said first scissor part and said second scissor part having a degree of blade line, based on a tangent line in contact with a center point of an arc of said blade portion and a line intersecting said center point and an end of said blade portion with an angle which is less than 20, at least one said grip portion having a shaft portion with an engaging groove, at least one said blade portion having an insertion portion with a cross section which is protrusion shaped, said insertion portion being formed corresponding to said engaging groove, said insertion portion having a shaft hole in a center thereof, for mounting said first and second scissor parts on each other via a shaft and said insertion portion having bolt holes provided at opposite sides of said shaft hole for fastening said blade portion to said grip portion, said grip portion includes a handle hole portion, adjustment means for changing a length of the said grip portion including an arm end of said shaft portion, formed in a shape of a pipe, and an arm end of said handle hole portion formed with a small diameter portion for inserting said arm end of said handle hole portion into said pipe, a stopper screw provided on said small diameter portion, said stopper screw protruding through an elongated hole provided extending through said shaft portion, said arm end of said handle hole portion being slidable within said pipe of said arm end of said shaft portion with said stopper screw extending through said elongated hole of said shaft portion for fixing said shaft portion to said handle hole portion.

2. A pair of blade replacement type scissors, comprising:

a first scissor part and a second scissor part, each scissor part having a grip portion connected to a blade portion, said blade portion of at least one of said first scissor part and said second scissor part having a degree of blade line, based on a tangent line in contact with a center point of an arc of said blade portion and a line intersecting said center point and an end of said blade portion with an angle which is less than 20, at least one said grip portion having a shaft portion connected to the corresponding said blade portion and having a handle hole portion, said handle hole portion being connected to said shaft portion for adjusting a length of said grip portion, said shaft portion having an arm end, said handle hole portion having an arm end formed with a small diameter portion allowing said arm end of said handle hole portion to be inserted into said arm end of said shaft portion, a stopper screw is provided on said small diameter portion so that said stopper screw protrudes through an elongated hole formed in said shaft portion, said arm end of said handle hole portion being capable of sliding within said pipe of said arm end of said shaft portion, and said stopper screw passing through said elongated hole of said shaft portion fixes said shaft portion to said handle hole portion.

3. A pair of scissors according to claim 2 in which one of the blade lines of said first scissor part and said second scissor part is straight while the blade line of the other scissor part is formed in the shape of an arc warped inward.

4. A pair of blade replacement type scissors, comprising:

a first scissor part and a second scissor part, each scissor part having a grip portion connected to a blade portion, said blade portion of at least one of said first scissor part and said second scissor part having a degree of blade line, based on a tangent line in contact with a center point of an arc of said blade portion and a line intersecting said center point and an end of said blade portion with an angle which is less than 20; means for adjusting a position of said grip portion relative to said blade portion; and interchangeable blade means for connecting and disconnecting said blade portion.

5. A pair of scissors according to claim 4 in which one of the blade lines of said first scissor part and said second scissor part is straight while the blade line of the other scissor part is formed in the shape of arc warped inward.

* * * * *